US006663459B2

(12) United States Patent
Ostolaza

(10) Patent No.: US 6,663,459 B2
(45) Date of Patent: Dec. 16, 2003

(54) TRANSPORTABLE PLAY SYSTEM, INCLUDING A BAG OR A BACKPACK, REVERSIBLY CONVERTIBLE INTO A PLAY SURFACE

(76) Inventor: Carmen Ostolaza, 113 Broadarrow Pl., Sanford, FL (US) 32773

( * ) Notice: Subject to any disclaimer, the term of this patent is extended or adjusted under 35 U.S.C. 154(b) by 0 days.

(21) Appl. No.: 10/039,123

(22) Filed: Dec. 31, 2001

(65) Prior Publication Data

US 2003/0124948 A1 Jul. 3, 2003

(51) Int. Cl.[7] ..... A63H 33/04

(52) U.S. Cl. ..... 446/75; 446/71; 383/4; 273/286

(58) Field of Search ..... 446/71, 75, 76, 446/79, 80, 227, 487, 488, 901; 434/309, 393, 428; 383/4; 224/577, 153; 273/157 R, 285, 286

(56) References Cited

U.S. PATENT DOCUMENTS

| | | | | | |
|---|---|---|---|---|---|
| 2,667,353 | A | * | 1/1954 | Lanice | 273/286 |
| 3,880,429 | A | * | 4/1975 | Blumenaus | 273/282.2 |
| 3,948,528 | A | * | 4/1976 | Goodman et al. | 273/286 |
| 4,372,077 | A | | 2/1983 | Balbuena | |
| 4,712,673 | A | | 12/1987 | Moore | |
| 4,874,340 | A | | 10/1989 | Smallwood | |
| 5,136,726 | A | * | 8/1992 | Kellin et al. | 2/244 |
| 5,577,730 | A | * | 11/1996 | Vannozzi, Sr. | 273/260 |
| 5,734,991 | A | * | 4/1998 | Schmid | 2/69 |

OTHER PUBLICATIONS

Pockets of Learning, Catalog of Creative, Interactive Learing toy, 1995/96, Feb. 16, 1996.*

Amazon.com: Fashion Polly! School Cool Backpack: Dance World. Dec. 11, 2001. http://www.amazon.com/exec/obidos/tg/stores/detail/–/toys/B00005B8HN/pictures/14/103–3.

Amazon.com: Key Charm Cuties Backpack: PJ Party. Dec. 11, 2001. http://www.amazon.com/exec/obidos/tg/stores/detail/–/toys/B000051X7Z/pictures/14/103–3.

Learning Curve/Our Brands–Feltkids. Oct. 22, 2002. http://www.learningcurve.com/ourProducts, 12 pages total, disclosing various felt toy products.

* cited by examiner

*Primary Examiner*—Derris H. Banks
*Assistant Examiner*—Bena B. Miller
(74) *Attorney, Agent, or Firm*—Joseph Fischer; Van Dyke & Assoc., P.A.

(57) ABSTRACT

A transportable play system simulating a backpack or bag unfolds to provide a self-adhering fabric play surface whereby children can create themes or stories by attaching self-adhering play pieces onto the fabric play surface. When the play surface in the closed position to simulate a bag or a backpack, the inner and outer surfaces are held together in a such configuration by hook and loop fasteners such as Velcro®, or other fastening means. Self-adhering play pieces are preferably pre-made to create a theme or story. In other embodiments, the user can create individualized play pieces with supplied fabric stock, and in other embodiments, specific game backgrounds can be added to allow playing of a transportable game. In one embodiment, several backpacks or bags can be interconnected to form a large play surface when unfolded into the open position. A bag or a backpack of the present invention also can be hung on a wall or other vertical surface, displaying a theme or design, and a supplemental section of play surface also can be added to such hanging bag or backpack.

19 Claims, 8 Drawing Sheets

TRANSPORTABLE PLAY SYSTEM, INCLUDING A BAG OR A BACKPACK, REVERSIBLY CONVERTIBLE INTO A PLAY SURFACE

FIELD OF THE INVENTION

The present invention relates to a novel unfoldable play system, such as a backpack or a purse-like bag, that is reversibly convertible, by unfolding, into a play surface, more specifically into a foldable play surface having removable attached play pieces that create a theme or story, such as for use by children for play and games.

BACKGROUND OF THE INVENTION

Children have always enjoyed listening to storytelling. Parents traditionally would read from books or make up their own stories to tell children before children go to sleep at night. Apart from or in concert with storytelling, flannel boards have been used with two-dimensional cutouts of characters so that children can act out their own stories using such characters to be used as aids in telling stories to children. Children enjoy stories associated with well-known flannel board characters as visual accompaniment. They can use the figures and retell the story on their own.

U.S. Pat. No. 4,372,077, issued on Feb. 8, 1983 to Dora O. Balbuena, discusses a combined book, flannel board and hand puppet. This patent includes a flannel board having figures representing characters, objects, or scenes from the storybook story and the puppet is a likeness of one of the story characters. The hand puppet is adapted to be manipulated by a hand in the normal manner and the puppet includes a storage pocket therein to receive and store the storybook, flannel board and flannel board figures.

U.S. Pat. No. 4,712,673, issued on Dec. 15, 1987 to Richard A. Moore, describes a combination food carrier and amusement device. The device includes a first and second panel having a removable bag member and a book secured to the inner surfaces thereof. The first and second panels are provided with removable handle portions which enable the device to transport food items retained in a bag member. The bag and the handle portions are disposable so that the device remains as a unique amusement device and book.

U.S. Pat. No. 5,734,991 issued on Apr. 7, 1998 to Marilyn Schmid, and describes a wearing apparel that has a background scene and may include detachable game pieces. The invention is directed to less costly wearing apparel which nonetheless includes specific areas, such as background scenes and other discrete areas to which attachable articles may be attached. Thus, an article of wearing apparel according to the invention includes an attaching portion (which has "loop or hook" elements for attachment of objects also having such elements) and a non-attaching portion (which lacks such attachment elements, and lowers the cost of such wearing apparel). One specific background scene is a checkerboard on the exterior flap of a backpack wearing apparel. The checker pieces are stored when not in use on a discrete attachment area on the exterior of the backpack away from the checkerboard. All other background scenes and attachment areas are similarly on the outside of the wearing apparel, and all use the hook and loop attachment means.

Other backpacks are sold on the market that open up to provide a play surface. These include clear plastic backpacks that contain three-dimensional solid figures, such as dolls, and associated objects, such as rugs and furniture. None of these figures or objects attach or stick to the play surface.

The play surfaces usually have a pre-made background that cannot be altered, or the background is also three-dimensional. One problem with such backpacks is that when the child is finished playing with the backpack/play surface, the theme or story as it has been developed during the playtime is disturbed when the backpack is closed. The child must then start anew the next time the backpack is opened.

Also, there are bags that contain game boards. One example is a design for a "Traveler's Game Board and Bag" in a crafts book, *Readers Digest Home Made Best Made*, copyright 2000, page 290–291. A soft checker game board design is shown, and instructions are provided for its fabrication. A soft bag closable by drawstring is also made from the same material. The soft bag is designed to hold the game board and game pieces during travel, and taken out for use when desired. The bag and the game board are completely separate, there is no means provided for changing the nature of the game surface, and there is no means to attach the pieces to the game board during or between uses.

An improvement over the presently known transportable play systems would comprise a suitable bag, including a backpack, that would include an exposable play surface where the play figures and objects would stick to the play surface sufficiently such that when the child has created a desired scene. Such play surface is folded, rolled, or otherwise stowed into the bag without destroying the scene or theme the child had created. This permits the child to continue with the story or theme when he/she reopens the backpack at another time or location. The present invention is directed to such an advance in the art.

All patents, patent applications and publications discussed or cited herein are understood to be incorporated by reference to the same extent as if each individual publication or patent application was specifically and individually set forth in its entirety.

SUMMARY OF THE INVENTION

The present invention relates to a novel combination play system, including a bag or a backpack, which comprises a play surface for children to create themes and stories, or alternatively, to play standard games. In one embodiment, a backpack unfolds into a fabric play surface, and with the backpack are included many attachable pre-cut fabric figures, such as characters (e.g., persons, wild animals, pets, heroes, known play characters) and objects (e.g., ships, buildings, vehicles, plants, hills, mountains, clothing, furniture), as well as backgrounds, for a child to arrange on the fabric play surface. The play surface can be refolded into a backpack for convenient portability without destroying the current theme or story created by the child or adult user. Alternately, where a specific background is employed over the base fabric play surface, such background can be rolled or otherwise folded, and stowed for later use.

In another embodiment a background can be provided that is a standard game board design, such as chess or checkers, or a proprietary game, such as Candyland®. In the latter case the present invention serves as a means to provide a portable version of such game, and a kit could be separately supplied that includes the specific background of such game, game pieces, instructions, and other necessary components such as dice, spinner, etc.

In another embodiment appropriate fabric is provided and children and/or supervising adult caretakers could use such material to make individualized characters of their choosing. Such characters could represent known story characters, the children, their friends, or characters of a story the children are creating.

It is an object of the present invention to provide a bag, such as a backpack, that is simple to operate and can store many play pieces to attach to the fabric play surface.

It is another object of the present invention to provide a bag, such as a backpack, having a foldable fabric play surface that can be altered by a child by similarly composed play pieces to tell a theme or story.

It is a further object of the present invention to provide a bag, such as a backpack, having a foldable fabric play surface that can be refolded into the bag or backpack while maintaining most or all of the positions of play pieces in the current theme or story.

It is still a further object of the present invention to provide several bags and/or backpacks that can be opened and attached together to form a larger fabric play surface to create a theme or story.

It is still another further object of the present invention to provide a bag, or more particularly a backpack, comprising a play surface and additionally comprising a fabric sheet material whereby the child or adult user can cut out their own play pieces to attach to the play surface.

It is still another further object of the present invention to provide a bag, or more particularly a backpack, having a play surface and additionally comprising figures and/or a material sheet that are/is translucent and colored. Such translucent pieces are provided or made that attach to the play surface and/or to opaque figures or objects attached to the play surface. The colored translucent pieces provide a learning tool in that when overlaid over other colors, the child so playing with the pieces learns what colors are made when specific colors are mixed together.

The foregoing has outlined some of the more pertinent objectives of the present invention. These objectives should be construed to be merely illustrative of some of the more prominent features and applications of the invention. Many other beneficial results can be attained by applying the disclosed invention in a different manner of modifying the invention as will be described.

It is to be understood that the foregoing general description and the following detailed description are exemplary and explanatory only and are not to be viewed as being restrictive of the present, as claimed. These and other objects, features and advantages of the present invention will become apparent after a review of the following detailed description of the disclosed embodiments and the appended claims.

DESCRIPTION OF THE PREFERRED EMBODIMENTS

Figure 1:
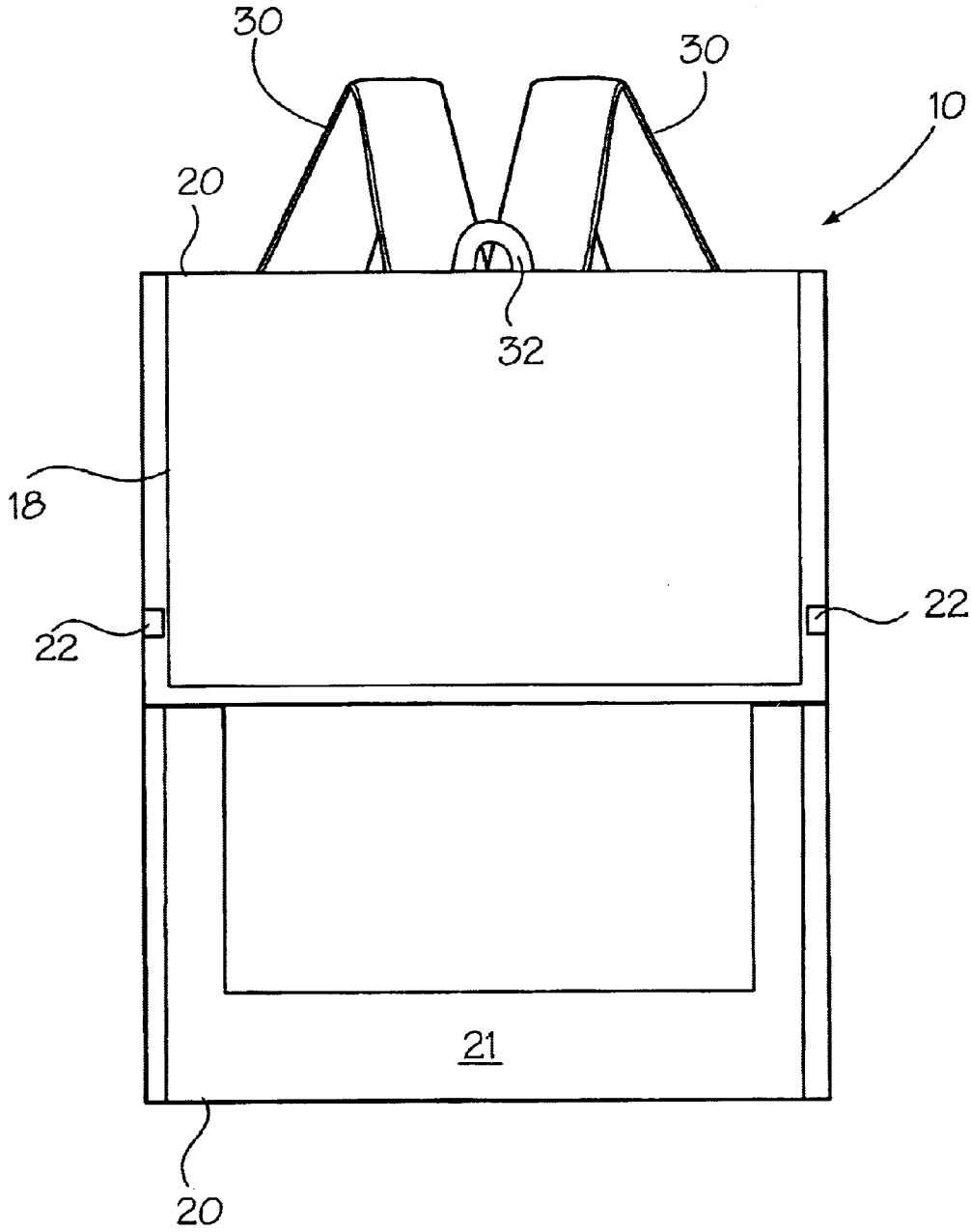
FIG. 1 shows a perspective front side view of the backpack in a folded closed position according to the present invention.

In describing the preferred embodiments of the invention illustrated in the drawings, specific terminology, including the terms defined below, will be used for the sake of clarity. However, the invention is not intended to be limited to the specific terms so selected. It is to be understood that each specific term includes all technical equivalents which operate in a similar manner to accomplish a similar purpose.

As used in this disclosure, a "figure," which is synonymous with a "play figure," is meant to include a fabric play piece that reversibly adheres to the background of the present invention, and includes, but is not limited to: shapes of generally recognizable generic bodies, such as a boy, a girl, an adult (parent, teacher, doctor, policeman, fireman and other professional adults); shapes of recognizable story characters (a witch, a serpent, a magician, etc.); shapes of known commercial characters (i.e., Barbie®, G.I. Joe®, etc.); shapes of feral animals (tiger, lion, giraffe, etc.); shapes of domesticated animals (horse, cow, goat, chicken, etc.); shapes of pets (dog, cat, fish, turtle, etc.), and the shapes of other characters that may perform acts in play situations.

As used in this disclosure, an "object," which is synonymous with a "play object," is meant to include a fabric play piece that reversibly adheres to the background of the present invention and is part of a play story and/or is acted upon by play figures, and includes, but is not limited to: letters of the alphabet; words; numbers; geometric shapes (circle, square, rectangle, etc.); a house or other building; a hill; a mountain; a tree or other plant; the sun; the moon; stars; vehicles (such as cars, trucks, airplanes, boats, ships); general depictions of scenery (such as a landscape, a city); clothing; and furniture.

As used in this disclosure, Pellicon® refers to membranous filter material that typically is used for filtration of pharmaceuticals, beverage, food, and biopharmaceutical products. In the present application, this material may used as the play surface since it may possess the characteristic that felt and other fabric figures and objects of the present invention tend to reversibly attach to the Pellicon® surface upon light to moderate pressure by a child.

A preferred material for the play surface is the fabric known as "pellon." This is a 100 percent polyester fabric. Another preferred material for the play surface is known as "Rainbow Bassic Felt™." This also is composed of 100 percent polyester. In one embodiment the color "Autumn White" of "Rainbow Bassic Felt™" was used with good results. In the present application, these two polyester materials are preferably used as the play surface since they possess the characteristic that felt fabric figures and objects of the present invention reversibly attach to these surfaces upon light to moderate pressure by a child. Such repeated reversible attachment has been found to be without noticeable loss of material to the background from felt figures and objects used for the play pieces. Also, it has been observed that one side of such polyester materials appear to be slightly superior to the opposite side for such attachment of felt figures. Confirmation of such observation has yet to be made.

It also is noted that the fabric of certain fabric figures and objects is made from blend fabrics that comprise, for instance, 75 percent polyester and 25 percent acrylic (such as a Baby Blue fabric), or 50 percent polyester and 50 percent acrylic (such as a Kelly Green fabric). Different blends, coming from different manufacturers, may provide slightly different adhesion characteristics.

One embodiment of the present invention relates to a novel combination backpack 10, shown in FIG. 1 in a closed orientation as it would be viewed from behind a person wearing the backpack. The main body of the backpack 10 is comprised of an outer surface, 18, and an inner surface, 16, and any additional structural components that may be sandwiched between these surfaces. The outer surface 18 comprises a front side, 11, and a back side, 13 (shown in FIG. 2). Attached to areas of the backpack are carrying means 30 which are preferably in the form of straps such that are known in the art of backpacks 10. However, any carrying means 30 can be utilized with the present invention 10, and 100, such as handles, etc. For instance, in the embodiment that is a bag 100 (shown in FIGS. 4 and 5) rather than a backpack, standard straps disposed from two sides of the bag can be employed. In other embodiments, the backpack 10 or the bag 100 may have a closure means other than a flap, 15, such as a simple snap, a zipper closure, other non-flap closure means, or a separate closure piece (such as an overlying cap or cover piece, said cap or cover piece being attached or not attached, as by a cord, etc.).

Figure 4:
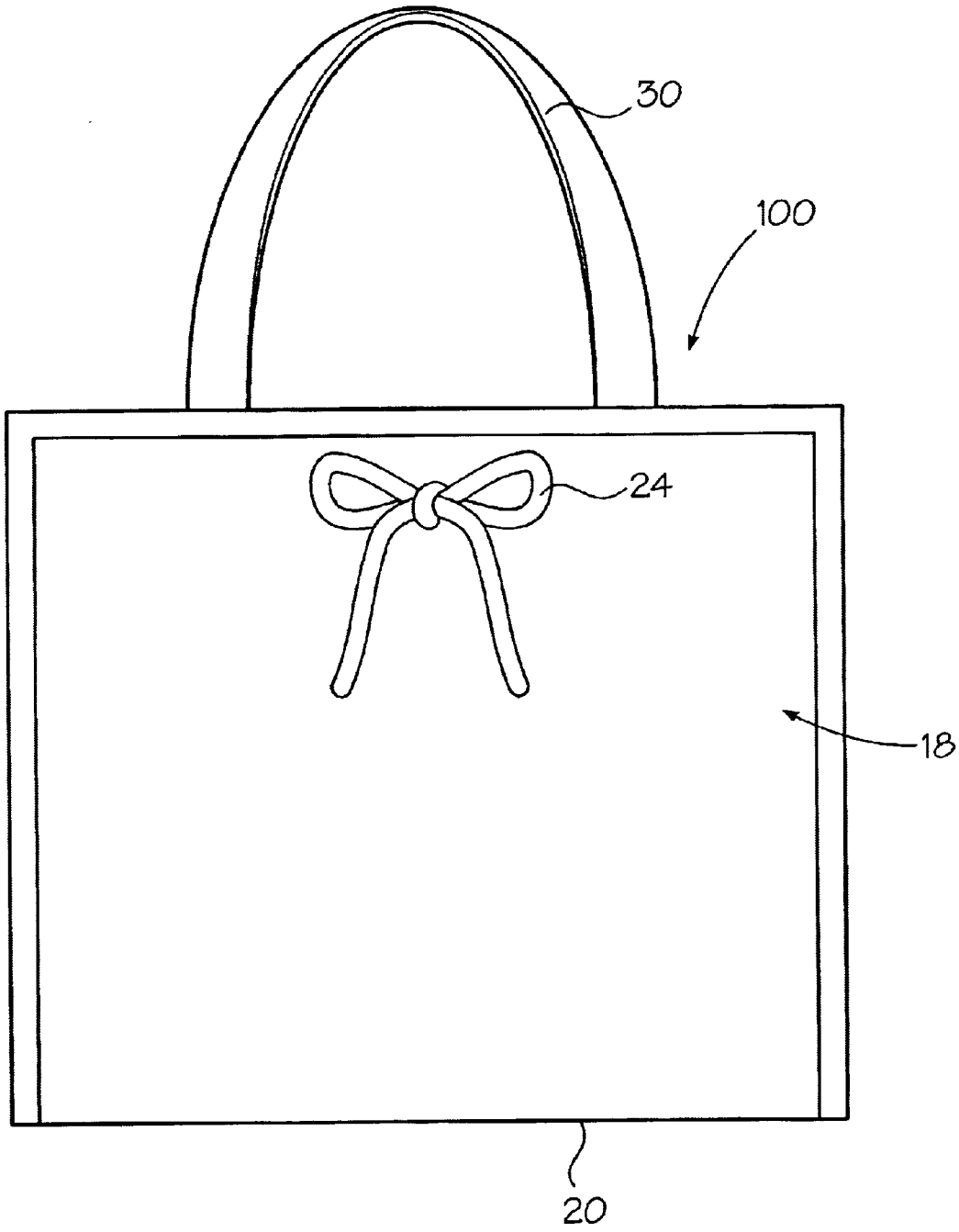
FIG. 4 shows a perspective side view of another embodiment of the play surface as a pouch in the folded closed position according to the present invention.
Figure 5:
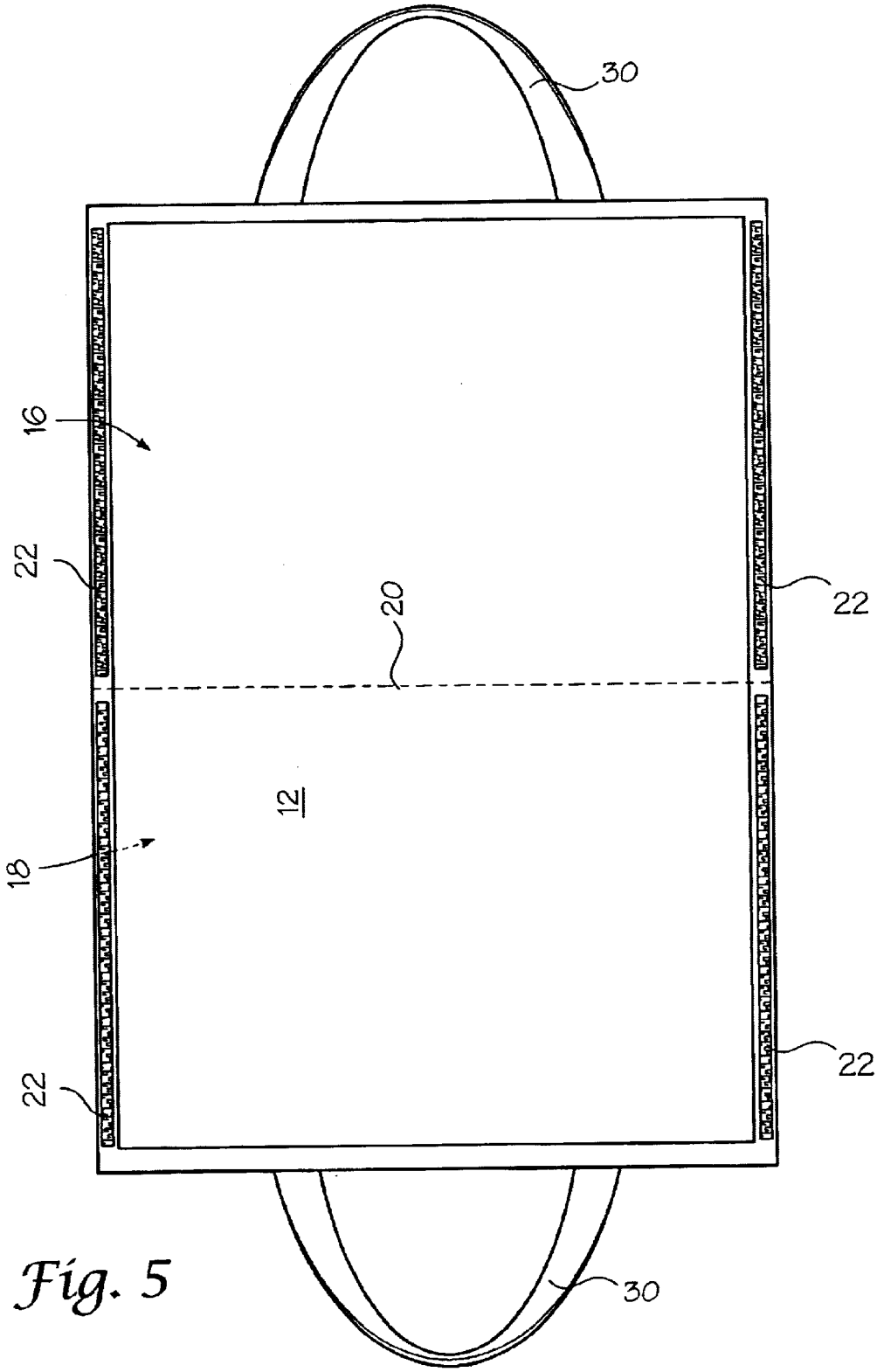
FIG. 5 shows a perspective view of the other embodiment of the play surface as a pouch in the unfolded open position exposing the fabric play surface according to the present invention.

It is generally known in the art of backpacks that straps such as are known in the art of making backpacks extend over the shoulders of the wearer of such backpacks. Also, as is generally known in the art of bags known as purses, or handbags, such as shown in FIGS. 4 and 5, that the strap-like carrying means are of varying lengths, including a length that allows the bag to be carried over the shoulders.

The outer surface 18 of the backpack, 10, generally comprises a flap, 15, which in FIG. 1 is shown reversibly attaching at opposite sides to the front side, 11, of the backpack 10 by small side connecting means, 22. In FIG. 1 the connecting means 22 is comprised of small pieces of hook and loop fasteners (also known as Velcro®).

The outer surface 18 may optionally include a hanging means 32 such as a loop for hanging the backpack 10 on a hook. The outer surface 18 may optionally also include at least one pocket or pouch 26 (being open or reversibly closable, such as by a zipper), the pocket or pouch 26 being sewn or otherwise attached to the outer surface 18 and used to store pre-made play pieces 14 or any other preferred items.

Figure 2:
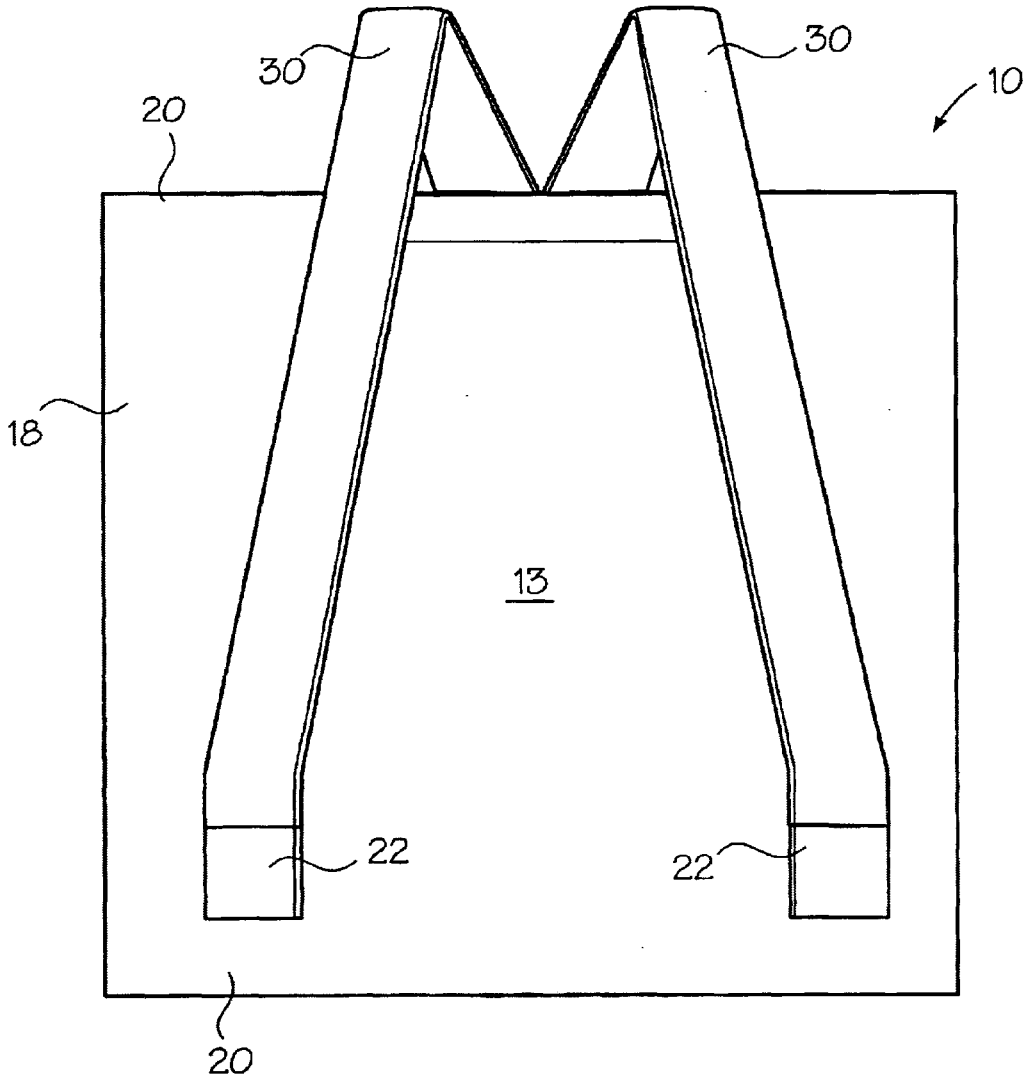
FIG. 2 shows a perspective back side view of the backpack in a folded closed position according to the present invention.

FIG. 2 shows the back view of the backpack 10 of FIG. 1, showing the back side, 13, of the outer surface, 18. Amply large (to support the anticipated load and stress from a child's use) hook and loop fasteners 22 are used to attach the ends of the carrying means, 30, to the outer surface, 18. As appropriate (but not shown), the carrying means can be of adjustable length, being adjustable by such adjustment means, buckles, dual loops, etc., as are commonly known and practiced in the art. FIGS. 1 and 2 also show fold lines, 20, the significance of which is better appreciated by viewing FIGS. 3A and 3B.

Figure 3A:
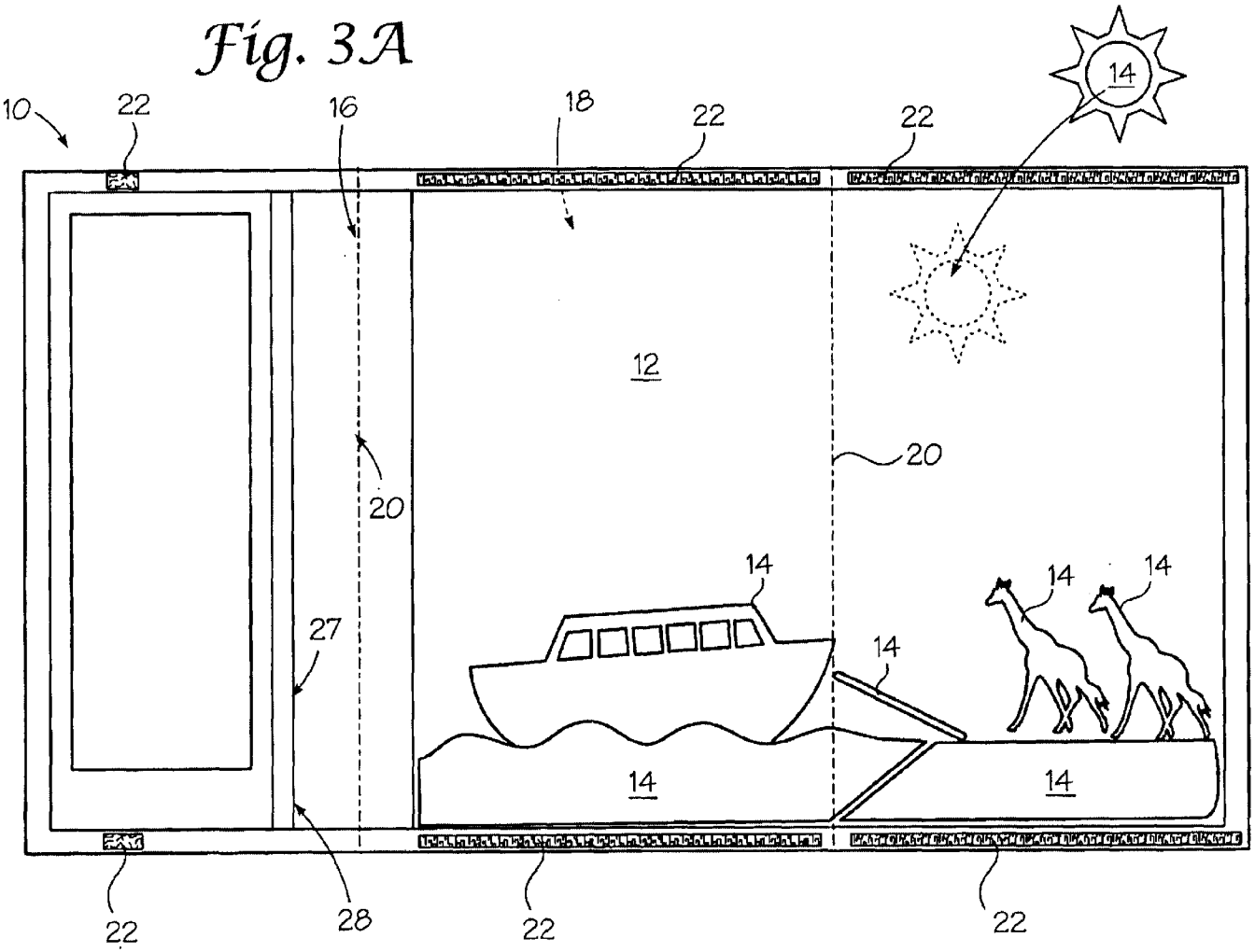
FIG. 3A shows a perspective view of the inner panel of the backpack in an unfolded open position exposing the fabric play surface according to the present invention, where the fabric play surface occupies less than the entire inner surface.

FIG. 3A exemplifies the backpack 10 in an unfolded, play surface configuration. The backpack 10 unfolds out to expose the inner surface, 16 said inner surface 16 comprising a fabric play surface 12 whereby children can create themes or stories by attaching play pieces 14 onto the fabric play surface 12. The backpack 10 is set up to be completely unfolded to an inner surface 16 that is either partially or completely a fabric play surface 12. FIG. 3A shows an embodiment in which the inner surface 16 is partially a fabric play surface. The other space is occupied by an inner fold pocket, 27, the opening of which is depicted as 28. Overlying this inner fold pocket 27 is an additional attached pocket, 26. The outer surface 18, which when folded functions as the backpack 10 exterior, is on the opposite side of the play surface 12.

Figure 3B:
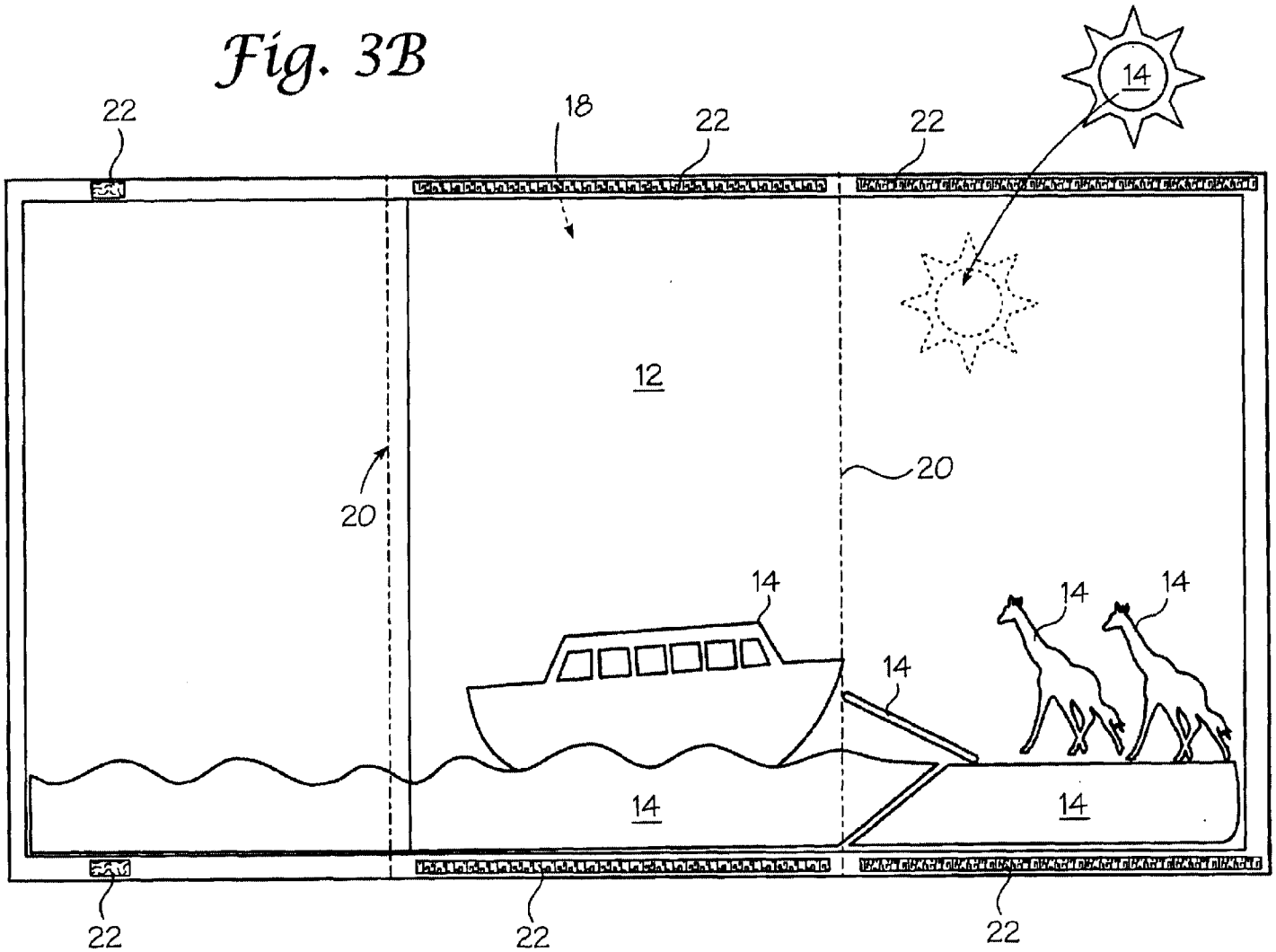
FIG. 3B shows a perspective view of the inner panel of the backpack in an unfolded open position exposing the fabric play surface according to the present invention, where the fabric play surface occupies essentially the entire inner surface.

Along the sides of play surface, 12, are shown connecting means, 22, that are comprised of linear strips of hook and loop fasteners. These fasteners serve to keep the sides of the structure together in the form of a backpack or bag, as the case may be. Hook and loop fasteners are the preferred means of fastening the sides of the backpack or bag together for younger children who may not easily operate a zipper. Also, the hook and loop fasteners are able to withstand a reasonable, expected load for a small child's backpack (one not typically used for heavy school books), and such fastening means are easily reversibly attached and separated. Other means of fastening the sides of the structure together, to form the backpack shape, can be zippers, ZipLock®-type fastening means, buttons, ties, interlocking snaps, and other means as are commonly known to those skilled in the art. Also, it is noted that a single zipper may be used as the connecting means, 22, to reversibly open and close the bag 100 or backpack 10. Such single zipper may operate by opening two adjacent sides of the bag 100 or backpack 10, so that the inner surface opens to one side (the non-zippered side). Alternately, two zippers may be placed, one on each of the left and right sides, and the bag 100 or backpack 10 may be opened as shown in FIGS. 3A, 3B, and 5. The use of zippers instead of hook and loop fasteners may be preferable for children that can easily operate the zippers.

The fabric play surface 12 comprises at least one fold or score line 20, whereby the panel 16 and 18 is adapted to be folded inwardly toward to a closed position wherein the outer surface 18 forms the backpack 10. When the backpack 10 is folded (shown in FIGS. 1–2), the inner 16 and outer 18 surfaces are held together in a backpack 10 configuration by a fastening means 22. Preferably, the fastening means 22 shown in FIG. 3 comprises hook and loop fasteners 22 located within the outer boundaries of the surfaces 16 and 18. However, the fastening means 22 can be located anywhere on the present invention 10 so that the play surface 12 folds into either a backpack 10 or bag 100. The most preferred hook and loop fasteners 22 would be Velcro®. Another suitable fastening means 22 includes interlocking snaps sewn onto the outer boundaries of the surfaces, or other closure means such as buttons, zippers, or the like.

As noted above, the inner surface 16 comprises either a completely fabric play surface 12 or a partial fabric play surface 12. FIG. 3B exemplifies an embodiment in which the play surface 12 completely occupies the inner surface 16.

The inner 16 and outer 18 surfaces of the backpack 10 may be covered with or include on a portion thereof a decorative material 24 (not shown) and/or identifying a logo or theme (not shown) such as Disney World®, Barbie®, or other famous commercialized products. The fabric play surface 12 background is usually, but not limited to, a plain background consisting of only one color. A solid one-color background does not limit the user to a specific scene or theme, thereby permitting the user to image any desired scene or theme. However, there may be fabric play surfaces 12 with specific sceneries or backgrounds. The most preferred fabric for the fabric play surface is one to which standard felt and other fabrics are self-adhering, but do not leave noticeable fabric remnants upon removal. It has been learned that preferred types of such fabric are known as "pellon" and "Rainbow Bassic Felt™."

Materials that adhere suitably to this play surface fabric, from which the play figures and objects (including backgrounds) are made, are selected form the group consisting of felt, heavy flannel, blotters, pipe cleaners, light carpet, cotton, rough string and yarn, suede leather, velvet, yarn and similar nappy materials. The play pieces 14 preferably are of a fabric such as a felt-type fabric. However, in some embodiments the play pieces 14 can be made of plastic or plasticized fabric. In these or in other embodiments, the play pieces 14 can be made of materials that are transparent or colored and translucent. Where the materials themselves do not inherently adhere to the selected fabric play surface 16 (e.g., plastic translucent play pieces), small pieces (e.g., small circles at various points) of appropriately adhering material are attached to the backside of figures and objects made of such non-inherently adhering materials. Such sections, comprised for instance of hook and loop material, provide a means of attachment.

In another embodiment, the play surface 16 may be made entirely of hook and loop type material, and the play pieces may be entirely or partially covered on their back sides with similar material. This is not the most preferred embodiment in that these materials and pieces are expensive and excessively adhering. Also, when typical felt fabric play pieces are attached to a hook and loop type play surface 16, it has been observed that pieces of the fabric remain on the play surface 16. This results in a less clean appearance of the play surface 16, and therefore is not the preferred means of adhering play pieces 14 to play surface 16.

The play pieces 14 may be pre-made in many shapes and sizes and include, but not limited to, characters, known themes such as biblical, people, animals, plants, vehicles, etc. The play pieces 14 preferably are specific to a theme or story, or combination of themes and stories. For instance, a series of play pieces and backgrounds may be provided to depict stories from the Bible. The play pieces 14 can also be foldable. One end of the inner surface 16 may form a pocket 26 or include a pocket and/or one end of the outer surface 18 may include at least one pocket 26 or pouch 28 sewn thereon. The pocket(s) 26 is preferably to store pre-made play pieces 14, but can store many other items too.

In another aspect of the present invention the fabric play surface 12 can be folded in the closed position in the shape of a bag 100 or purse having at least one carrying means 30 for portability of the fabric play surface 12 shown in FIG. 4. As for the backpack 10 described above, the main body of the bag 100 is comprised of an outer surface, 18, and an inner surface, 16, and any additional structural components that may be sandwiched between these surfaces. FIG. 5 shows the bag 100 in the open position exposing the fabric play surface 12, which in this embodiment occupies the entire inner surface, 16. The present invention 100 may also include fabric sheets (not shown) of different colors whereby the child or adult user may cut out play pieces 14 in desired shapes, sizes, characters, backgrounds, etc. This allows the user to develop their own visuals. Sometimes, play pieces 14 can be copied directly from a picture book or from a simple coloring book. An opaque projector can be also be used, if the play pieces 14 in the book are not too large. Visuals can also be copied from a filmstrip, by projecting a small image and copying the play pieces 14 directly. Simple free hand sketches or cutouts can also be developed. Crayons, magic markers, liquid crayons, watercolor paints, and the like can also be used to color the play pieces 14.

In another aspect of the present invention several backpacks 10 or bags 100 can be interconnected to form a large fabric play surface 12 when unfolded into the open position. Each backpack 10 may comprise a fastening means 22 such as hook and loop fasteners such as Velcro® or any other fastening means like interlocking snaps by which two or more backpacks are joined together. This permits more than one child to co-create a theme or scene on the play surface of more than one backpack so joined. The present invention 10 and 100 can be used on a small table or area behind the fabric play surface 12 to lay out the play pieces 14 in the order in which they will appear in the story or may also be held in the user's lap.

Figure 6A:
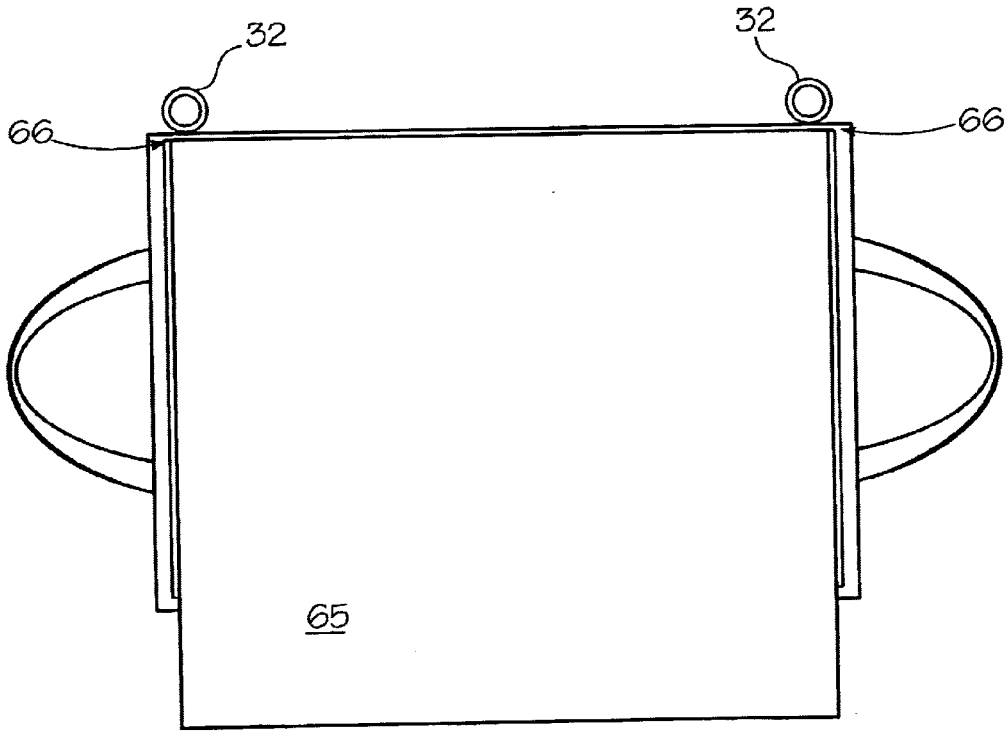
FIG. 6A depicts the placement of an additional play surface section, attached at the top edge of an opened bag of the present invention, that itself is hanging from a wall or other vertical surface.
Figure 6B:
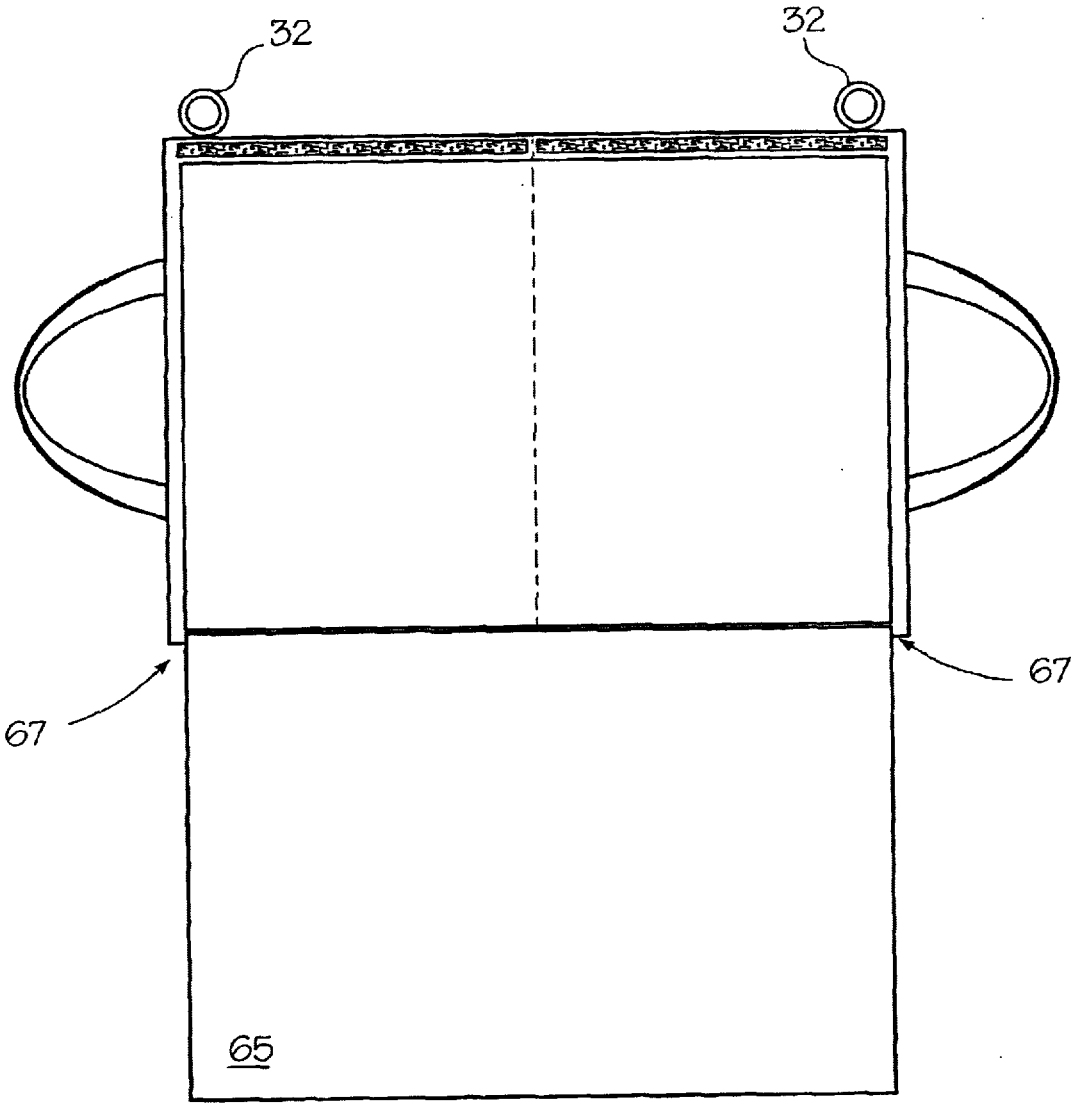
FIG. 6B depicts the placement of an additional play surface section, attached at the bottom edge of an opened bag of the present invention, that itself is hanging from a wall or other vertical surface.

The present invention 10 and 100 may be hung on a wall in the open position by at least two hanging means 32 affixed to opposing corners (see FIG. 6A). Such hanging can display a current scene or theme already attached to the fabric play surface 12, or, as shown in FIG. 6A, a supplemental play surface, 65, may be attached over the existing play surface, 12, to present a new or larger play surface. Such play surface, 65, covers the play surface 12 by attachment to the upper corners 66. Alternately, as shown in FIG. 6B, the additional play surface 65 may be attached to the lower corners 67. (It is noted that no fold line is shown in FIG. 6B. This accurately reflects the covering up of the line by the additional play surface, 65. This is in contrast to FIGS. 3A and 3B, where one or more fold lines are shown although they actually lie below the surface. The latter were shown for clarity of the description of the invention.) The additional play surfaceprovides additional opportunities to create play scenes or themes.

The outer surface 18 can be made of waterproof materials to protect the inner contents of the present invention 10 and 100 from getting wet. The present invention 10 and 100 are constructed to be machine washable for easy clean up. The present invention 10 and 100 is ideal for children in quiet places to play such as church or public places because the entire fabric play surface 12 and components 14 are made of quiet materials. For example, a child could create a biblical scene or theme in church without disturbing the session and learn more about the bible.

Children love stories illustrated by placing characters and creating a scenery placed on a fabric play surface 12. Many simple picture books and traditional stories work well with fabric play surfaces 12. Among these are classic fable tales, including Aesop's tales, fairy tales, and many others.

It should be understood that the examples and embodiments described herein are for illustrative purposes only and that various modifications or changes in light thereof will be suggested to persons skilled in the art and are to be included within the spirit and purview of this application and the scope of the appended claims. Having generally described this invention, including the best mode thereof, those skilled in the art will appreciate that the present invention contemplates the embodiments of this invention as defined in the following claims, and equivalents thereof. However, those skilled in the art will appreciate that the scope of this invention should be measured by the claims appended hereto, and not merely by the specific embodiments exemplified herein. Those skilled in the art will also appreciate that more sophisticated technological advances will likely appear subsequent to the filing of this document with the Patent Office. To the extent that these later developed improvements embody the operative principles at the heart of the present disclosure, those improvements are likewise considered to come within the ambit of the following claims.

What is claimed is:

1. A transportable play system comprising:

a. a main body simulating a bag in closed position, comprising an outer surface and an inner surface, wherein the inner surface comprises a non-hook-and-loop fabric play surface to which play pieces are reversibly adherable wherein each of said play pieces comprises as at least one component a non-hook-and-loop adhering fabric surface for contact to said fabric play surface;

b. a carrying means attached to said main body for portability of said play system; and c. at least one fastening means for securing said main body in a closed, folded position to simulate the bag;

wherein the play system in said closed position is transportable as said bag, and in an open, unfolded position provides a said fabric play surface to which said play pieces are reversibly adherable during play and game activities.

2. The transportable play system of claim 1, additionally comprising at least one said play pieces that is reversibly adhering to said play surface.

3. The transportable play system of claim 2, additionally comprising separately purchased pre-made play pieces, comprised of fabric adherable to said fabric play surface to either add to a pre-existing story or theme or to create a completely different story or theme.

4. The transportable play system of claim 1, wherein said carrying means is in the form of a handle.

5. The transportable play system according to claim 4, wherein said carrying means comprises over the shoulders carrying means.

6. The transportable play system according to claim 1, wherein said at least one fastening means is selected from the group consisting of hook and loop fasteners, interlocking snaps, buttons, zippers, and any combination thereof.

7. The transportable play system of claim 1, wherein two or more said transportable play systems unfolds into its respective fabric play surface and each respective said fabric play surface attaches to another respective fabric play surface by said fastening means to create a combined large play surface.

8. The transportable play system of claim 1, additionally comprising one or more sheets of fabric for fabrication of fabric play pieces.

9. The transportable play system of claim 1, wherein said transportable play system further comprises a non-chess portable game board attachable to or imprinted on said fabric play surface.

10. A transportable play system comprising:

a. a main body simulating a backpack in closed position, comprising an outer surface and an inner surface, wherein the inner surface comprises a non-hook-and-loop fabric play surface to which play pieces are reversibly adherable, wherein each of said play pieces comprises as at least one component a non-hook-and-loop adhering fabric surface for contact to said fabric play surface;

b. a carrying means attached to said main body for portability of said play system; and c. at least one fastening means for securing said main body in a closed, folded position to simulate the backpack;

wherein the play system in said closed position is transportable, and in an open, unfolded position provides a play surface to which said play pieces are reversibly adherable during play and game activities.

11. The transportable play system of claim 10, additionally comprising at least one of said play pieces that is reversibly adhering to said play surface.

12. The transportable play system of claim 11, additionally comprising separately purchased pre-made play pieces, comprised of fabric adherable to said fabric play surface can be purchased separately to either add to a pre-existing story or theme or to create a completely different story or theme.

13. The transportable play system of claim 10, wherein said carrying means is in the form of a handle.

14. The transportable play system according to claim 10, wherein said carrying means comprises over the shoulders carrying means.

15. The transportable play system according to claim 10, wherein said at least one fastening means is selected from the group consisting of hook and loop fasteners, interlocking snaps, buttons, zippers, and any combination thereof.

16. The transportable play system of claim 10, wherein two or more said transportable play systems unfolds into its respective fabric play surface and each respective said fabric play surface attaches to another respective fabric play surface by said fastening means to create a combined large play surface.

17. The transportable play system of claim 10, additionally comprising one or more sheets of fabric for fabrication of fabric play pieces.

18. A transportable play system comprising:

a. a main body simulating a bag or a backpack, said main body comprising an outer surface and an inner surface, wherein the inner surface comprises a non-hook-and-loop fabric play surface to which at least one play piece is reversibly adherable, wherein each of said play pieces comprises as at least one component a non-hook-and-loop adhering fabric surface for contact to said fabric play surface;

b. said at least one play piece that is reversibly adhering to said play surface;

c. a carrying means attached to said main body for portability of said play system; and d. at least one fastening means for securing said main body in a closed, folded position to simulate the bag;

wherein the play system in said closed position is transportable, and in an open, unfolded position provides said fabric play surface to which said at least one play piece is reversibly adherable during play and game activities.

19. A method of using a transportable play system, comprising:

a. carrying said transportable play system to a desired play location, wherein said transportable play system is comprised of:

1. a main body simulating a bag in closed position, comprising an outer surface and an inner surface, wherein the inner surface comprises a non-hook-and-loop fabric play surface to which play pieces are reversibly adherable, wherein each of said play pieces comprises as at least one component a non-hook-and-loop adhering fabric surface for contact to said fabric play surface;

2. a carrying means attached to said main body for portability of said play system; and 3. at least one fastening means for securing said main body in a closed, folded position to simulate the bag;

b. opening said transportable play system by separating said at least one fastening means to expose said non-hook-and-loop fabric play surface; and c. contacting one or more said reversibly adhereable non-hook-and-loop play pieces to said non-hook-and-loop fabric play surface in such a way as to create a play scene, story or theme, or to play a game.

* * * * *